US011330368B2

(12) United States Patent
McElveen et al.

(10) Patent No.: US 11,330,368 B2
(45) **Date of Patent: *May 10, 2022**

(54) PORTABLE MICROPHONE ARRAY APPARATUS AND SYSTEM AND PROCESSING METHOD

(71) Applicant: Wave Sciences, LLC, Charleston, SC (US)

(72) Inventors: James Keith McElveen, Charleston, SC (US); Gregory S. Nordlund, Jr., Charleston, SC (US)

(73) Assignee: Wave Sciences, LLC, Charleston, SC (US)

( * ) Notice: Subject to any disclaimer, the term of this patent is extended or adjusted under 35 U.S.C. 154(b) by 43 days.

This patent is subject to a terminal disclaimer.

(21) Appl. No.: 16/867,541

(22) Filed: May 5, 2020

(65) Prior Publication Data

US 2020/0267472 A1 Aug. 20, 2020

Related U.S. Application Data

(63) Continuation-in-part of application No. 16/036,410, filed on Jul. 16, 2018, now Pat. No. 10,645,492, (Continued)

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2499/15* (2013.01)

(58) Field of Classification Search
CPC .. H04R 2201/401; H04R 3/005; H04R 17/02; H04R 1/086; H04R 1/406; H04R 1/08; H04R 1/2892; H04R 25/407; H04R 2430/20; H04R 31/006; H04R 2201/02; H04S 2400/15; G06F 3/01; G06F 3/011; G06F 3/013; G06F 3/167; G06F 3/16; G10L 15/22; G02B 27/017
(Continued)

(56) References Cited

U.S. PATENT DOCUMENTS

2008/0170472 A1* 7/2008 Yonak ..... G01S 5/18 367/129
2011/0170705 A1* 7/2011 Kanamori ..... H04R 3/005 381/92
2012/0330653 A1* 12/2012 Lissek ..... H04R 1/406 704/226

* cited by examiner

*Primary Examiner* — Leshui Zhang
(74) *Attorney, Agent, or Firm* — Gregory Finch; Finch Paolino, LLC

(57) ABSTRACT

An apparatus, system and method for a portable microphone array system comprising a computing device and a case having an array of microphones embedded or integrated into the case. A user may position the laptop and case facing the general direction of a target audio source to capture a target acoustic audio input at the microphone array. The microphone array may deliver a first stage of beamformed audio from the acoustic audio input to the computing device via a communications interface or bus. The computing device may comprise an audio processor configured to perform one or more successive audio processing steps to process the audio input and render a digital audio output. The digital audio output may be outputted from the computing device to an audio output device, such as headphones or an earpiece.

17 Claims, 11 Drawing Sheets

Related U.S. Application Data which is a continuation of application No. 14/703,981, filed on May 5, 2015, now Pat. No. 10,028,053.

(60) Provisional application No. 62/929,642, filed on Nov. 1, 2019.

(58) Field of Classification Search
USPC ..... 381/92, 26, 56, 57, 115, 122, 337, 339, 381/345, 346, 347, 350, 351, 355, 356, 381/357, 358, 359, 360, 361, 365, 364, 381/366, 373, 374, 375; 455/575.1, 455/575.2, 575.3, 575.4, 575.6; 700/94
See application file for complete search history.

PORTABLE MICROPHONE ARRAY APPARATUS AND SYSTEM AND PROCESSING METHOD

CROSS-REFERENCE TO RELATED APPLICATIONS

The present application is a continuation-in-part of U.S. patent application Ser. No. 16/036,410 filed Jul. 16, 2018, which in turn is a continuation of U.S. patent application Ser. No. 14/703,981 filed May 5, 2015, now U.S. Pat. No. 10,028,053. The present application also claims the benefit of U.S. Provisional Application No. 62/929,642 having a priority filing date of Nov. 1, 2019 and entitled, "APPARATUS AND SYSTEM FOR ELECTRONIC DEVICE HOUSING WITH INTEGRATED MICROPHONE ARRAY." The contents of each of these previously filed applications are hereby incorporated by reference herein in their entirety.

FIELD

The present disclosure relates to the field of electronic device accessories; in particular, a portable microphone array apparatus and system and processing method.

BACKGROUND

A wide variety of acoustic transducers, such as microphones, are commonly used to acquire sounds from a target audio source, such as speech from a human speaker. The quality of the sound acquired by microphones is adversely affected by a variety of factors, such as attenuation over the distance between the target audio source to the microphone(s), interference from other acoustic sources particularly in high noise environments, and sound wave reverberation and echo.

One way to mitigate these effects is to use a directional audio system, such as a shotgun microphone, a parabolic dish microphone, or a microphone array beamformer. All three approaches create constructive and destructive interference patterns between sounds arriving at them to create directional audio pickup patterns that discriminate based upon those angles of arrival. Beamforming broadly describes a class of array processing techniques that are operable to create/form a pickup pattern through a combination of multiple microphones to form an interference pattern (i.e., a "beam"). Beamforming techniques may be broadly classified as either data-independent (i.e., where the directional pickup pattern is fixed until re-steered) or data-dependent (i.e., where the directional pickup pattern automatically adapts its shape depending from which angle target and non-target sounds arrive). Prior art microphone array beamforming systems include, broadly, a plurality of microphone transducers that are arranged in a spatial configuration relative to each other. Some embodiments allow electronic steering of the directional audio pickup pattern through the application of electronic time delays to the signals produced by each microphone transducer to create the steerable directional audio pickup pattern. Combining the signals may be accomplished by various means, including acoustic waveguides (e.g., U.S. Pat. No. 8,831,262 to McElveen), analog electronics (e.g., U.S. Pat. No. 9,723,403 to McElveen), and digital electronics (e.g., U.S. Pat. No. 9,232,310 to Huttunen et al.). The digital systems include a microphone array interface for converting the microphone transducer output signals into a different form suitable for processing by a digital computing device. The digital systems also include a computing device such as a digital processor or computer that receives and processes the converted microphone transducer output signals and a computer program that includes computer readable instructions, which when executed processes the signals. The computer, the computer readable instructions when executed, and the microphone array interface form structural and functional modules for the microphone array beamforming system.

Microphone array beamforming techniques are commonly used to reduce the amount of reverberation captured by the transducers. Excessive reverberation negatively affects the intelligibility and quality of captured audio as perceived by human listeners, as well as the performance of automatic speech recognition and speech biometric systems. Reverberation is reduced by microphone array beamformers by reducing the contribution of sounds received from directions other than the target direction (i.e., where the "beam" is directed).

In scenarios having multiple sound sources, such as when a group of speakers are engaged in conversation, e.g. around a table, the sound source location or active speaker position in relation to the microphone array changes. In addition, more than one speaker may speak at a given time, producing a significant amount of simultaneous speech from different speakers in different directions relative to the array. Furthermore, more than one sound source may be located in the same general direction relative to the array and therefore cannot be discriminated solely using direction of arrival techniques, such as microphone array beamforming. In such a complex environment, the effective acquisition of target sound sources requires simultaneous beamforming in multiple directions in the reception space around the microphone array to execute the aforementioned data-adaptive technique. This requires fast and accurate processing techniques to enable the sound source location and robust beamforming techniques to address undesirable audio effects.

Through applied effort, ingenuity, and innovation, Applicant has identified a number of the deficiencies and problems with prior microphone array systems and microphone array processing methods.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a portable microphone array apparatus comprising a portable housing configured to be selectively coupled to a surface of a mobile electronic device; a plurality of transducers disposed on a surface of the portable housing, the plurality of transducers comprising a microphone array configured to receive an arriving audio signal, the microphone array being configured such that the plurality of transducers are oriented adjacent to the surface of the mobile electronic device when the mobile electronic device is selectively coupled to the portable housing; and output circuitry operably engaged with the plurality of transducers and configured to deliver a first stage audio input from the microphone array to the mobile electronic device.

In accordance with certain embodiments, the mobile electronic device may be selected from the group consisting of laptop computers, smartphones, tablet computers, digital display devices, and personal computers. The portable microphone array apparatus may be configured wherein the output circuitry further comprises at least one data transfer interface configured to deliver the first stage audio input from the microphone array to the mobile electronic device. The at least one data transfer interface may comprise a wireless or a wired communications interface. In some embodiments, the microphone array comprises one or more input channels. The portable microphone array apparatus may be configured wherein the output circuitry is configured to beamform audio signals from the one or more input channels to comprise the first stage audio input.

Further aspects of the present disclosure provide for a portable microphone array system comprising a portable housing comprising a plurality of transducers coupled to a surface of the portable housing, the plurality of transducers comprising an array being configured to receive an arriving audio signal; and a computing device selectively coupled to a surface of the portable housing, the computing device comprising an audio processing module communicably engaged with the microphone array via at least one data transfer interface to receive the arriving audio signal, wherein the audio processing module is configured to process the arriving audio signal according to one or more audio processing steps to spatially filter at least one target audio signal from one or more non-target audio signals present within the arriving audio signal to generate a processed audio output.

In accordance with certain embodiments, the portable microphone array system may further comprise an audio output device operably engaged with the computing device to receive the processed audio output. The audio output device may be selected from the group consisting of headphones, hearing aids, loudspeakers, and audio cables. The portable microphone array may be configured wherein the plurality of transducers are oriented adjacent to a surface of the computing device when the computing device is selectively coupled to the portable housing. In some embodiments, the audio processing module may be configured to render a processed audio output comprising at least one target audio signal. In accordance with certain aspects of the portable microphone array system, the one or more audio processing steps may comprise determining at least one acoustic propagation model for the least one target audio signal. In some embodiments, the one or more audio processing steps comprise calculating a normalized cross power spectral density for the arriving audio signal. The one or more audio processing steps may further comprise applying a whitening filter to the arriving audio signal, wherein the whitening filter is configured to suppress one or more non-target audio signals from the processed audio output.

Still further aspects of the present disclosure provide for a portable microphone array system comprising a portable housing comprising a plurality of acoustic sensors comprising a microphone array configured to receive an audio input; and a computing device selectively coupled to at least one surface of the portable housing, the computing device comprising an audio processing module communicably engaged with the microphone array via at least one data transfer interface to receive the audio input, the audio processing module comprising at least one processor and a non-transitory computer readable medium having instructions stored thereon that, when executed, cause the processor to perform one or more audio processing operations, comprising processing the audio input to determine at least one acoustic propagation model for at least one source location within an acoustic environment; and processing the audio input according to the at least one acoustic propagation model to spatially filter at least one target audio signal from one or more non-target audio signals within the audio input to derive a processed audio output, wherein the at least one target audio signal corresponds to the at least one source location; and render a processed audio output comprising the at least one target audio signal.

In accordance with certain embodiments, the portable microphone array system may be configured wherein the at least one acoustic propagation model comprises at least one Green's Function estimation. The portable microphone array system may further comprise an audio output device operably engaged with the computing device to receive the audio output. The audio output device is selected from the group consisting of headphones, hearing aids, loudspeakers, and audio cables. In certain embodiments, the one or more audio processing operations may further comprise calculating a normalized cross power spectral density for the audio input. The one or more audio processing operations may further comprise applying a whitening filter to the audio input, wherein the whitening filter is configured to suppress one or more non-target audio signals from the processed audio output.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
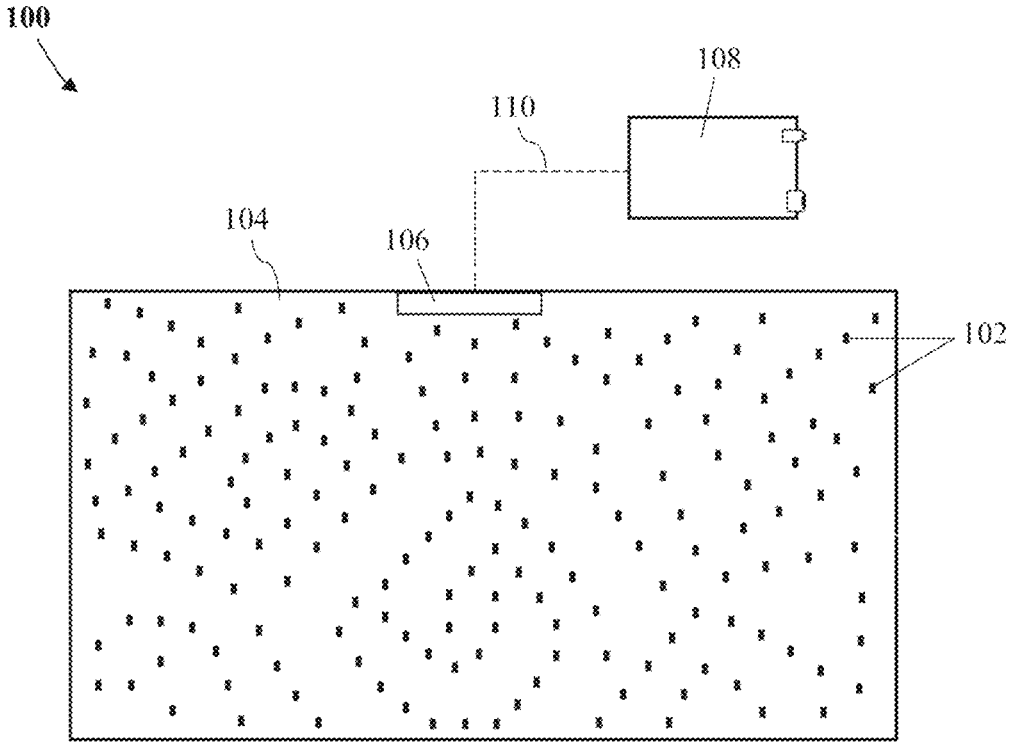
FIG. 1 is a schematic diagram of a portable microphone array, in accordance with certain aspects of the present disclosure.

Before the present invention and specific exemplary embodiments of the invention are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, exemplary methods and materials are now described. All publications mentioned herein are incorporated herein by reference to disclose and describe the methods and/or materials in connection with which the publications are cited.

It must be noted that as used herein and in the appended claims, the singular forms "a," "an," and "the" include plural referents unless the context clearly dictates otherwise. Thus, for example, reference to "a transducer" includes a plurality of such transducers and reference to "the signal" includes reference to one or more signals and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may differ from the actual publication dates which may need to be independently confirmed.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein the term "sound" refers to its common meaning in physics of being an acoustic wave. It therefore also includes frequencies and wavelengths outside of human hearing.

As used herein the term "signal" refers to any representation of sound whether received or transmitted, acoustic or digital, including target speech or other sound source.

As used herein the term "noise" refers to anything that interferes with the intelligibility of a signal, including but not limited to background noise, competing speech, non-speech acoustic events, resonance reverberation (of both target speech and other sounds), and/or echo.

As used herein the term Signal-to-Noise Ratio (SNR) refers to the mathematical ratio used to compare the level of target signal (e.g., target speech) to noise (e.g., background noise). It is commonly expressed in logarithmic units of decibels.

As used herein the term "microphone" may refer to any type of input transducer.

As used herein the term "array" may refer to any two or more transducers that are operably engaged to receive an input or produce and output.

As used herein the term "audio processor" may refer to any apparatus or system configured to electronically manipulate one or more audio signals. An audio processor may be configured as hardware-only, software-only, or a combination of hardware and software elements.

In accordance with various aspects of the present disclosure, recorded audio from an array of transducers (including microphones and other electronic devices) may be utilized instead of live input.

In accordance with various aspects of the present disclosure, the spatial audio array processing system may be implemented in a receive-only, transmit-only, or bi-directional embodiments as the acoustic Green's Function models employed are bi-directional in nature.

Certain aspects of the present disclosure provide for a portable microphone array apparatus and system that does not require knowledge of an array configuration or orientation to improve SNR in a processed audio output. Certain objects and advantages of the present disclosure may include a significantly greater (15 dB or more) SNR improvements relative to beamforming and/or noise reduction speech enhancement approaches. In certain embodiments, an exemplary system and method according to the principles herein may utilize four or more input acoustic channels and as one or more output acoustic channel to derive SNR improvements.

Certain objects and advantages include providing for a portable microphone array apparatus and system that is robust to changes in an acoustic environment and capable of providing undistorted human speech and other quasi-stationary signals. Certain objects and advantages include providing for a spatial audio processing system and method that requires limited audio learning data; for example, two seconds (cumulative).

In various embodiments, an exemplary system and method according to the principles herein may process audio input data to calculate/estimate, and/or use one or more machine learning techniques to learn, an acoustic propagation model between a desired location of a sound source relative to one or more array elements within an acoustic space. In certain embodiments, the one or more array elements may be co-located and/or distributed transducer elements.

Embodiments of the present disclosure are configured to accommodate for suboptimal acoustic propagation environments (e.g., large reflective surfaces, objects located between the desired acoustic location and the transducers that interfere with the free-space propagation, and the like) by processing audio input data according to a data processing framework in which a Green's function including one or more boundary conditions is applied to derive an acoustic propagation model for an acoustic location or environment.

In various embodiments, an exemplary system and method according to the principles herein may utilize one or more audio modeling, processing, and/or rendering framework comprising a combination of a Green's Function algorithm and whitening filtering to derive an optimum solution to the Acoustic Wave Equation for the subject acoustic space. Certain advantages of the exemplary system and method may include enhancement of a desired acoustic location within the subject acoustic space, with simultaneous reduction in all other the subject acoustic locations. Certain embodiments enable projection of cancelled sound to a desired location for noise control applications, as well as remote determination of residue to use in adaptively canceling sound in a desired location.

In various embodiments, an exemplary system and method according to the principles herein is configured to construct an acoustic propagation model for a desired acoustical location containing a point source within a linear acoustical system. In accordance with various aspects of the present disclosure, no significant practical constraints other than a point source within a linear acoustical system are imposed to construct the acoustic propagation model, such as (realizable) dimensionality (e.g., 3D acoustic space), transducer locations or distributions, spectral properties of the sources, and initial and boundary conditions (e.g., walls, ceilings, floor, ground, or building exteriors). Certain embodiments provide for improved SNR in a processed audio output even under "underdetermined" acoustic conditions, i.e., conditions having more noise sources than microphones.

Certain exemplary devices, systems and methods of the present disclosure provide for a portable microphone array apparatus and system configured to spatially process a target audio signal from a point source within a three-dimensional acoustic space. In certain embodiments, the target audio signal is a human voice associated with a person speaking to, or in proximity of, the user of the portable microphone array apparatus and system within an acoustic space (e.g., a classroom or lecture hall). The exemplary portable microphone array apparatus and system may be configured to receive an audio input comprising the speaker's voice, spatially process the audio input to extract and whiten the speaker's voice from the audio input and suppress/exclude other audio signals being present within the audio input, and render/output a digital audio output comprising the processed target audio signals. In certain embodiments, the system is configured to output the digital audio output to headphones or a hearing aid.

Certain exemplary embodiments of the present disclosure provide for an apparatus, system and method for a portable microphone array system comprising a laptop computer and a laptop computer case having an array of microphones embedded or integrated into the laptop computer case. Aspects of the present disclosure enable a portable microphone array system that provides for a user to selectively house a laptop or tablet computer in a case containing an array of microphones. A wireless or wireline communications interface or bus is established between the computer and the array of microphones, such that the computer may receive a first stage of beamformed audio from the microphone array. A user may position the computer and case so that the outer surface having the microphone array underneath is facing generally in the direction of a target audio source to capture a target acoustic audio input at the microphone array. The microphone array may deliver a first stage of beamformed audio from the acoustic audio input to the computer via the wireless communications interface or bus. The computer's central processing unit (CPU) may comprise an audio processing module/software to perform one or more successive audio processing steps to process the first stage of beamformed audio to render a digital audio output. The digital audio output may then be output from the computer to an output device, such as headphones or other hearing device.

Aspects of the present disclosure enable users with hearing difficulties or disabilities to use a computer, being operably engaged with a computer case having an embedded or integrated microphone array, to steer a directivity pattern of the microphone array toward a target audio source (for example, a teacher presenting a lecture in a classroom or lecture hall) to capture a target audio source input and render an audio output to an earpiece or other audio output device. Embodiments of the present disclosure solve the problems associated with the use of hearing aids or assisted listening devices in noisy or reverberant environments through the following, non-limiting, functional advantages: (a) ease of use and implementation by pairing a directional audio array with the user interface of a computer; (b) enhanced audio processing capabilities, as compared to prior art solutions, through the interface with a computer; (c) efficient use of a sufficient number of transducers in the microphone array to simultaneously have high gain, high directivity, and high side lobe attenuation; (d) ability to provide consistent directionality of received audio across the frequencies of interest; (e) ability to enable the construction of an microphone array into a fabric substrate that is hidden from view; (f) ability to enable the construction of a directional audio array that is immune to radio frequency (RF) interference, such as from mobile phones; and, (g) ability to enable the construction of a directional audio array with low cost of construction, high reliability, high temperature operation, light weight, high portability, and simplicity of operation.

Reference will now be made descriptively to the drawings, in which similar reference characters denote similar elements throughout the several views. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description of various embodiments of the present invention, numerous specific details are set forth in order to provide a thorough understanding of the present invention. In other instances, well-known methods, procedures, protocols, services, components, and circuits have not been described in detail so as not to unnecessarily obscure aspects of the present invention.

Referring now to certain aspects of the present disclosure in more detail, FIG. 1 illustrates a microphone array and audio processing module according to an embodiment of the present disclosure. In accordance with certain aspects of the present disclosure, a microphone array 100 is comprised of an array surface 104 with surface mounted or embedded microphones 102 and output circuitry 106. In an embodiment, array surface 104 may be constructed of a printed circuit board with surface mounted microphones 102. Array surface 104 may be constructed from other substrates with printed circuits, conductive wires, or other means to connect the microphones 102 using wired or wireless techniques. In an embodiment, array surface 104 is defined as a fabric substrate comprising a surface of a portable computing device case. In said embodiment, microphones 102 may be woven into or otherwise coupled to the fabric substrate and operably engaged via a plurality of conductive fibers to define array surface 104. Microphones 102 may be mounted on an interior or exterior surface of array surface 104 and/or may otherwise be embedded into the fibers of array surface 104 in embodiments where array surface 104 is constructed from fabric substrate. In an embodiment, microphones 102 may be arranged in a nested circle configuration with fractal-based spacing between the circles and microphones. In some embodiments, microphones 102 may comprise acoustic transducers including digital microphones, analog microphones or a combination thereof.

Sound captured by microphones 102 on the array surface 104 may be sent to an audio processing module (APM) 108 through an electrical bus 110. APM 108 is optional to the function of microphone array 100 and serves to perform audio processing functions such as time delay, second stage beamforming, gain or volume control and audio filtering. APM 108 may be omitted from embodiments where these audio processing functions are not required by the commercial application in which microphone array 100 is applied. APM 108 may be integral to or mounted on array surface 104 or may be executed on an external processor of an electronic device; such as a laptop computer, tablet computer or smart phone. In an embodiment, APM 108 includes a USB connection that provides DC power from a remote battery source or other electrical power source and may also provide an audio, video, programming, and or control interface to a laptop or other computing device. APM 108 may include an output connection interface for a listening headset and an additional audio output. In other embodiments, APM 108 may be fully integrated into a computer's CPU and may be embodied as an all software embodiment or a combination of hardware and software elements. In further illustrative embodiments, APM 108 may be embodied as a one or more integrated circuits (IC), chipsets, or other circuitry components comprising firmware and/or software being operably interfaced with one or more of microphones 102 directly on the array surface. In such embodiments, APM 108 may operably interface with microphones 102 to perform one or more of the audio processing steps described herein directly at the array level. In such embodiments, the laptop or other communicably interfaced electronic device would be communicably configured to receive fully or partially processed audio. Further in regard to such embodiment, it is anticipated that APM 108 may be directly communicably coupled with one or more audio output devices as described herein to communicate a fully rendered audio output directly to an audio output device. In such embodiments, the laptop may be configured to serve as a user interface to configure one or more processing variables, steering, directivity pattern, sensitivity, volume, output variables, and/or other control variables of the array and/or output device. In still further embodiments, the laptop or other electronic device may be operationally separate/distinct from microphone array 100 and may serve only as a supporting surface upon which microphone array 100 is disposed and/or engaged.

Other variations on this construction technique include, but are not limited to, microphones connected using wired, wireless or optical interconnects, arranged in the same or similar geometric pattern and mounted on or in a host device; the main array board made of other materials, such as hard PCB or fabric with conductive wires or other substances to electrically connect the microphones to the electronics module, power, and ground; other arrangements of microphones, such as equal, random, Golden Spiral, and Fibonacci spacing; and embodiment variations that include vibration, rubbing, or sound absorbing layers of neoprene rubber, felt, or similar materials on top and/or bottom.

Other variations on this construction technique are anticipated, including but not limited to embedding APM 108 inside of other housings or devices, such as using analog or digital electronics, including DSPs (digital signal processors), ASICs (application specific integrated circuits), FPGA (field programmable gate arrays) and similar technologies, to implement generally the same signal processing using digital devices as is being accomplished using analog and/or hybrid devices. Other variations on this construction technique further include the use of wireless links to replace one or more cables; the use of one or more wireless communications protocols, such as BLUETOOTH, for outputting audio and/or module control; use of a USB interface for outputting audio and/or module control; and the integration of the electronics contained in the audio processing module onto array board 104. In some embodiments, array board 104 may be omitted in place of digital circuitry being configured as a bus/communications interface directly between one or more digital microphones and the laptop computer, such that an arriving acoustic signal received by microphones 102 is directly input into the laptop computer.

Figure 2:
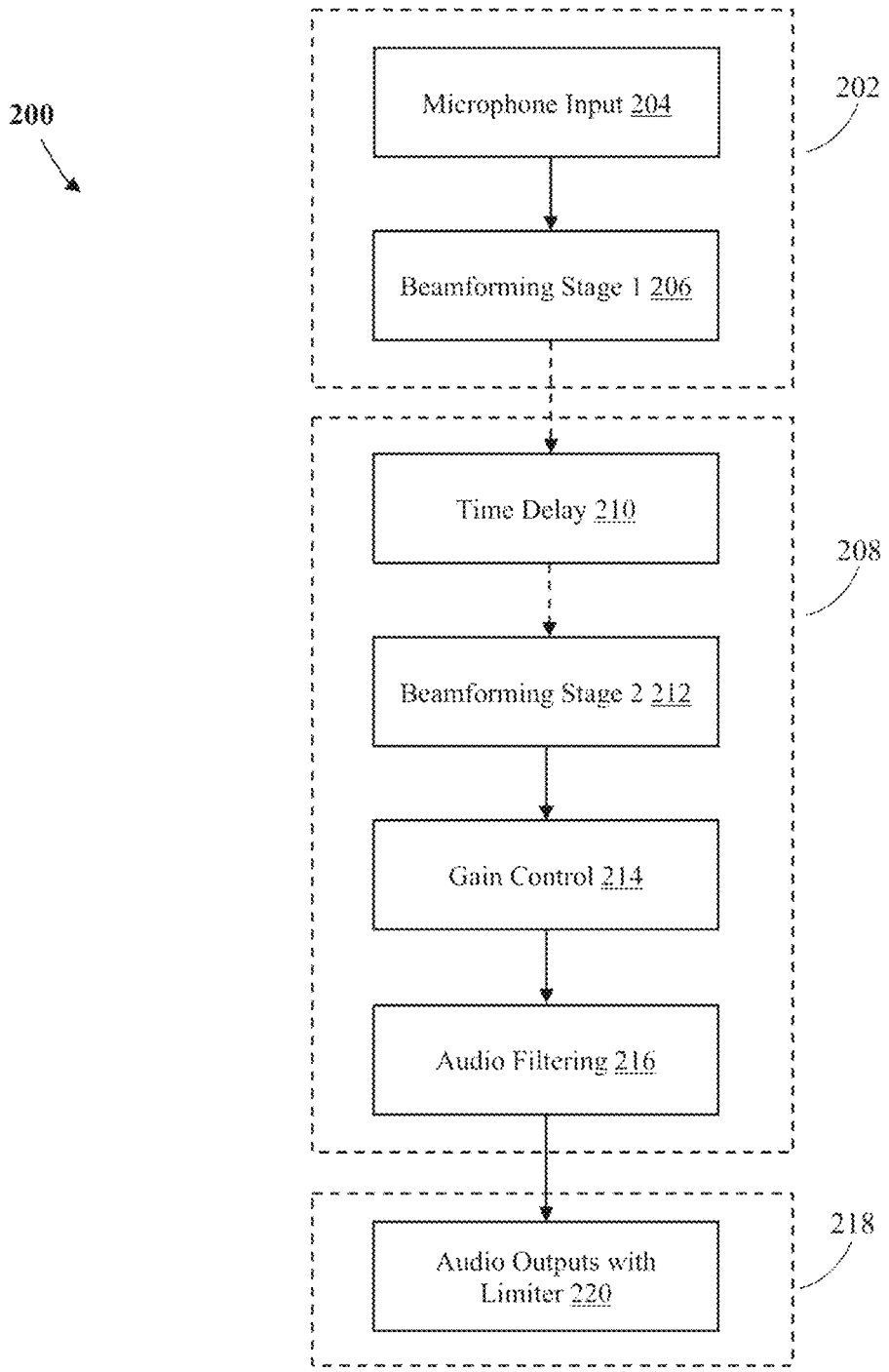
FIG. 2 is a process flow diagram illustrating an audio processing method, in accordance with certain aspects of the present disclosure.

Referring now to FIG. 2, a process flow diagram illustrating an array processing method 200 in accordance with certain aspects of the present disclosure is shown. According to an embodiment, array processing method 200 comprises an audio input routine 202 configured to capture arriving sound from a target source on an array surface to comprise an audio input; at least one audio processing routine 208 configured to receive the audio input and perform one or more successive audio processing steps to reduce sounds arriving from directions other than the acoustic corollary of field-of-view; and an audio output routine 218 configured to render and output a digital audio output. Array processing method 200 may be implemented within a portable microphone array apparatus and system. In accordance with certain aspects of the present disclosure, a portable microphone array apparatus is configured to capture acoustic signals from a target source as a microphone input 204. In certain embodiments, the acoustic signals may be beamformed in single or multiple groups in a first stage of beamforming 206. The acoustic signals may be beamformed in single or multiple groups directly on an electrical bus into single or multiple channels. In an embodiment, audio signals from the first stage of beamforming may be communicated to an audio processing module. In certain embodiments, the audio processing module may reside locally on a mobile computing device being communicably engaged with the portable microphone array apparatus. In some embodiments, the audio processing module may be embodied as a distributed system in which one or more audio processing functions may be executed across one or more external systems in a distributed computing environment.

In accordance with certain aspects of the present disclosure, audio processing routine 208 may be operably configured wherein an audio input comprising pre-beamformed channel or channels may be processed to apply one or more engineered time delay at a first audio processing step 210. The audio input may then be processed at a second or subsequent audio processing step 212 comprising a second stage of beamforming to accomplish or help to accomplish steering of the pick-up pattern (beam), signal cancellation, or signal separation. Linear or automatic gain control, which may also include dynamic range control and similar amplitude filtering, may be applied at an audio processing step 214. In certain embodiments, audio frequency filtering may then be applied at an audio processing step 216. Audio processing routine 208 may provide processed audio data to audio output routine 218. Audio output routine 218 may render the processed audio data to produce an audio output 220, optionally with one or more limiter. In accordance with certain aspects of the present disclosure, the portable microphone array apparatus and system may comprise at least one audio output device. An audio output device may include, but is not limited to, a line, microphone, headphone or wireless audio output, or may be incorporated into analog or digital audio and/or video formats communicated to one or more computing devices. The one or more computing devices may include laptop computers, tablet computers, digital photo and video cameras, computer monitors, smartphones, personal computers, servers, and/or other telecommunications networks comprising one or more remote servers. While the present disclosure provides a description of certain embodiments of the portable microphone array apparatus and system in which a laptop computer is operably incorporated, such embodiments are purely illustrative and are non-limiting. It is readily anticipated that the inventive concepts of the present disclosure may be readily reduced to practice in fundamentally the same manner as described herein for embodiments comprising tablet computers, smartphones, personal computers, and/or other computing devices being readily configured to interface with a portable microphone array apparatus.

Figure 7:
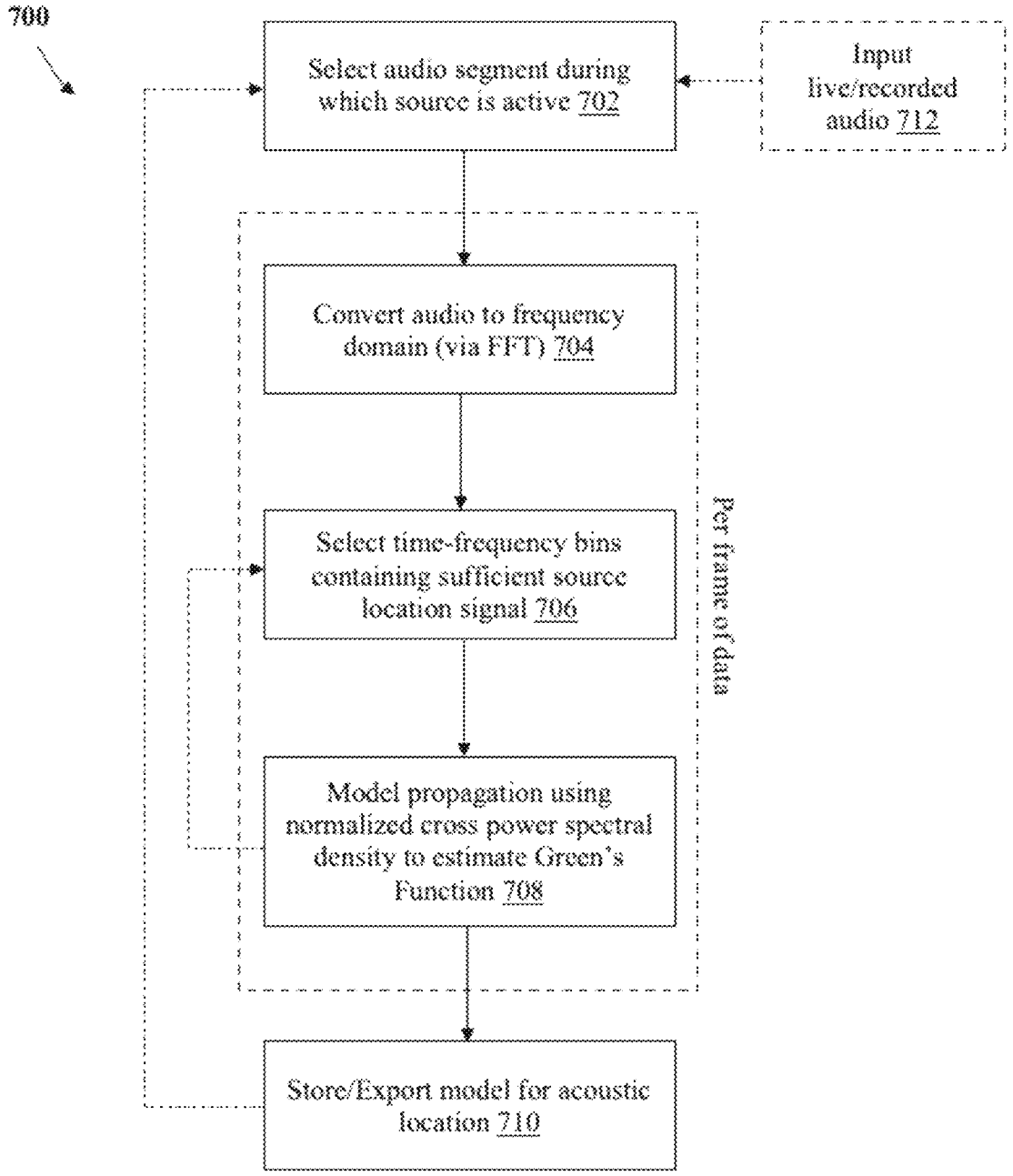
FIG. 7 is a process flow diagram of an audio processing routine, in which one or more aspects of the present disclosure may be embodied.
Figure 8:
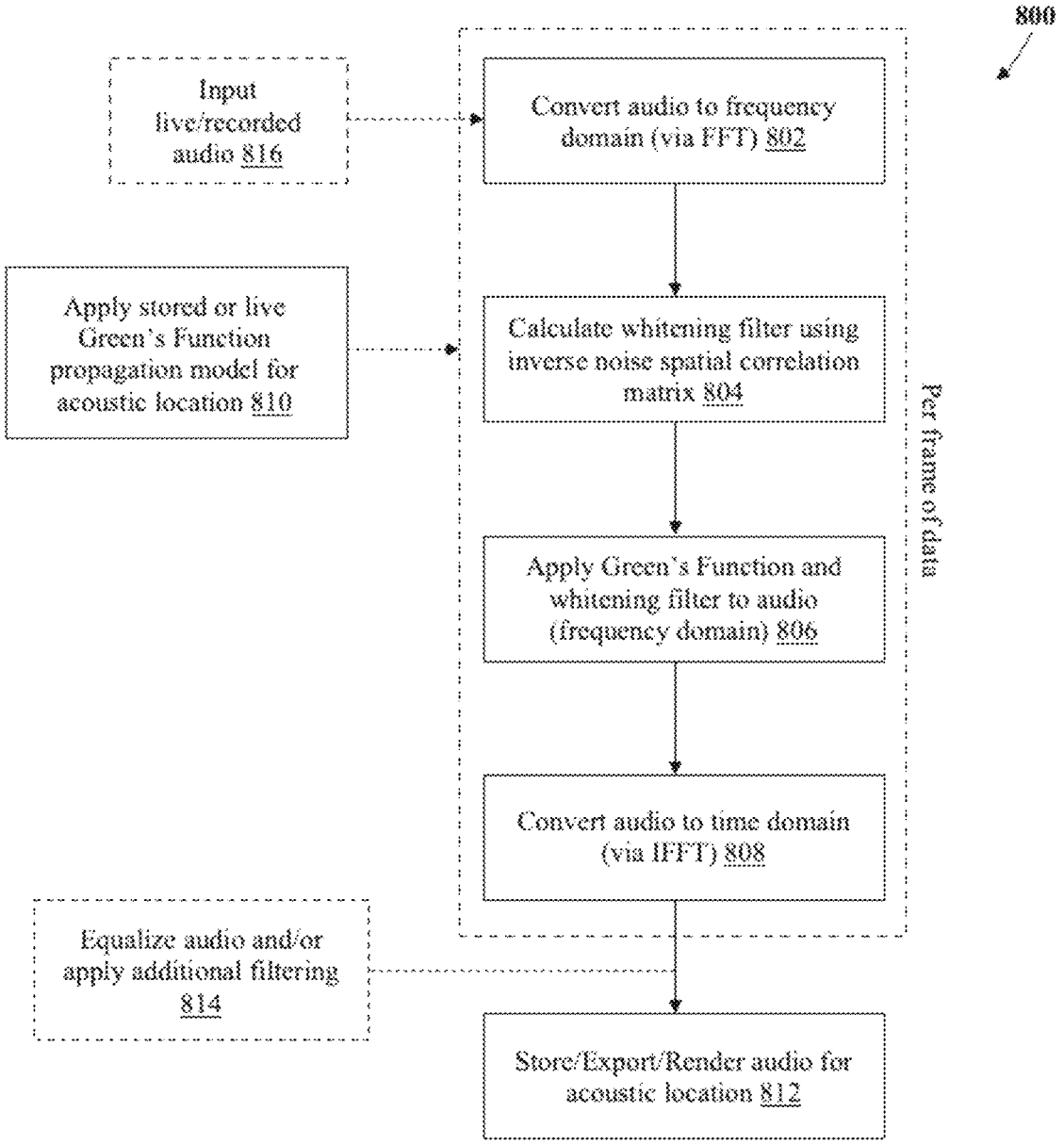
FIG. 8 is a process flow diagram of an audio processing routine, in which one or more aspects of the present disclosure may be embodied.

In certain embodiments, array processing method 200 may further comprise additional successive stages of beamforming; alternative orders of filtering and gain control; use of reference channel signals to remove directional or ambient noises; use of time or phase delay elements to steer the directivity pattern; the use of digital microphones and digital signal processing to accomplish the same general technique; and the use of one or more signal separation algorithms instead of or in addition to one or more beamforming stages. In certain embodiments, array processing method 200 may be performed without first stage beamforming 206 and/or second stage beamforming 212. In some embodiments, array processing method 200 may comprise or be otherwise incorporated within one or more aspects of audio processing routine 700 and/or audio processing routine 800 (as shown in FIGS. 7 and 8).

Figure 3A:
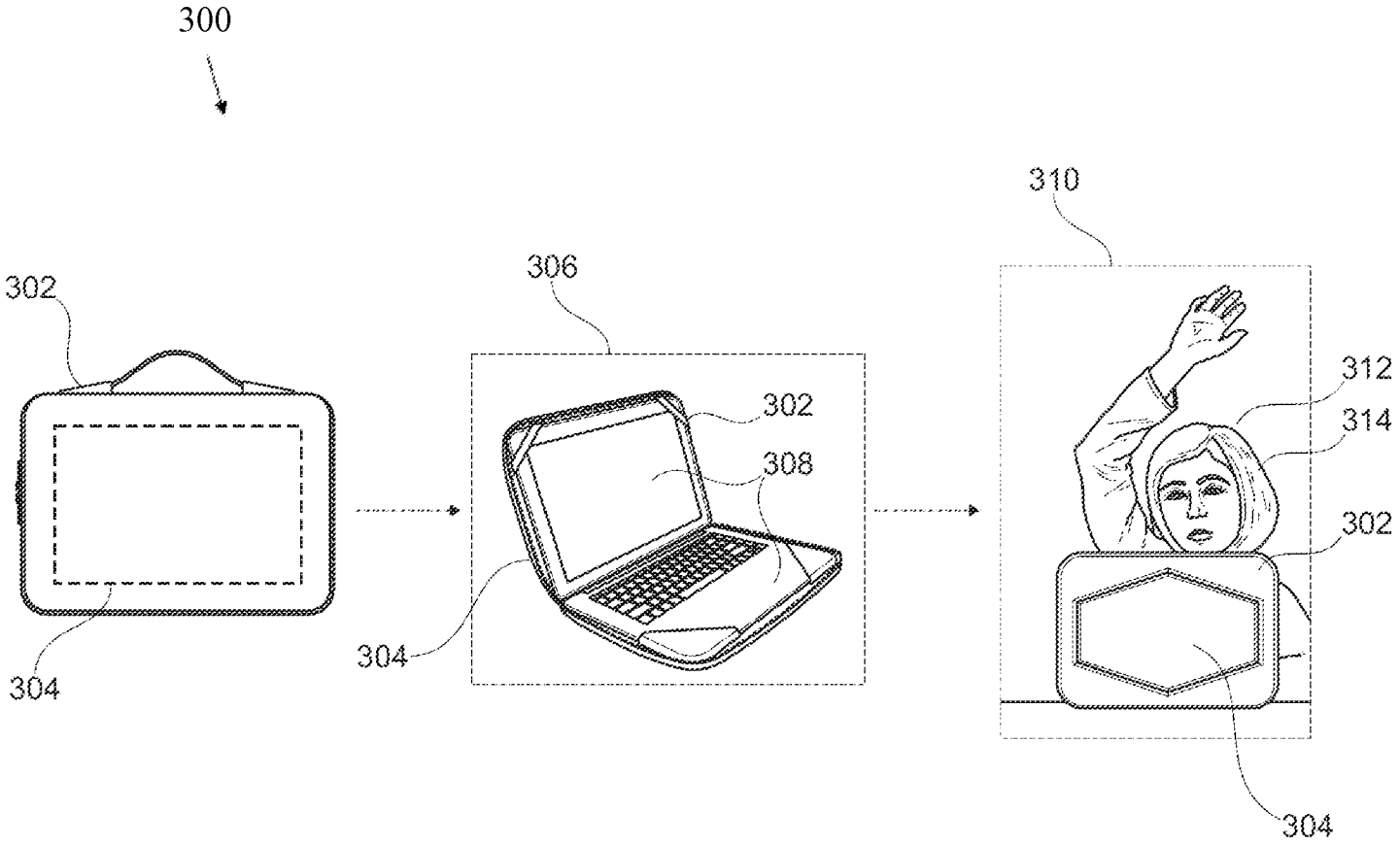
FIG. 3A is a functional diagram of a portable microphone array apparatus and system, in accordance with an aspect of the present disclosure.

Referring now to FIG. 3A, a functional diagram of a portable microphone array system 300 is shown. In accordance with an aspect of the present disclosure, a portable microphone array system 300 is generally comprised of a laptop computer case 302, a laptop computer 308, and an audio output device 314. Laptop computer case 302 may be a folio-style, shell-style, or sleeve-style case, or other common style of case or accessory for interface with laptop computers or other mobile electronic devices and may be constructed of fabric. Laptop computer case 302 may be substantially rectangular in shape and may have a zipper that extends substantially the perimeter of the laptop computer case such that laptop computer case 302 is approximately folded in half when the zipper is closed. Laptop computer case 302 may have an outer surface and an inner surface, preferably constructed from fabric (but optionally constructed from plastic). The dimensions of laptop computer case 302 may vary according to the dimensions of the laptop computer intended to be housed therein. In a preferred embodiment, laptop computer case 302 comprises a microphone array 304 that may be embedded in the fabric of outer surface, or otherwise integrated into laptop computer case 302 between the outer surface and the inner surface. In embodiments where an outer surface laptop computer case 302 is constructed from fabric, the fabric should be of a type/kind that enables acoustic signals to pass therethrough. In embodiments where microphone array 304 is integrated or housed between the outer surface and the inner surface of laptop computer case 302, microphone array 304 may optionally comprise a flexible printed circuit board or other array substrate upon which a plurality of transducers (e.g. microphones) may be mounted.

Figure 3B:
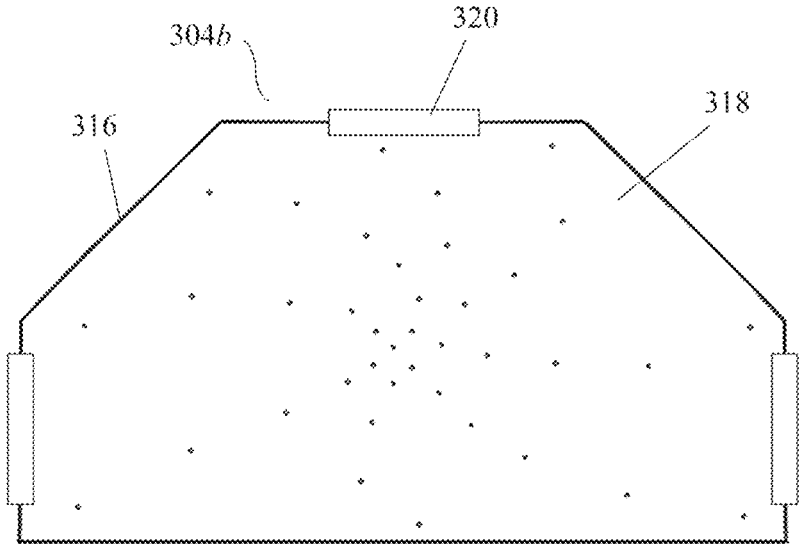
FIG. 3B is a functional diagram of an array surface of a portable microphone array apparatus, in accordance with an aspect of the present disclosure.

Referring now to FIG. 3B, with cross-reference to FIG. 3A, microphone array apparatus 304*b* may comprise an array surface 316 constructed of a substantially stretchable or bendable fabric being capable of passing acoustic signals therethrough; for example, neoprene, spandex blend, and the like. Array surface 316 may be selectively coupled to or integrated within laptop computer case 302 or may be separate from laptop computer case 302 and directly interfaced with laptop 308 during use. In accordance with embodiments in which array surface 316 is directly interfaced with laptop 308, array surface 316 may be folded or rolled for storage and unfolded or unrolled and selectively coupled to laptop 308 when in use. Array surface 316 may comprise a plurality of individually wired microphones 318 being directly woven or surface-mounted onto array surface 304*b*. Array apparatus 304*b* may have one or more retention clips 320 configured to be selectively attached to a surface of an electronic device, such as a laptop computer, tablet computer, mobile phone, and/or other electronic device as described herein. Retention clips 320 may be substituted by one or more alternative attachment means being capable of selectively coupling array surface 304*b* to a surface of an electronic device; for example, adhesive strips, hook-and-loop fasteners, magnets, and/or mechanical fittings, clamps and the like.

In accordance with certain embodiments, and still referring to FIG. 3A, portable microphone array system 300 may further comprise one or more additional sensors being integral or communicably interfaced with laptop computer case 302 and/or laptop computer 308. Additional sensors may include video cameras, motion sensors, other cameras, environmental sensors, biometric or biofeedback sensor, and other sensors configured to receive one or more environmental-based, occupant-based, or user-based inputs. In certain embodiments, system 300 may be configured to utilize a video camera optionally in conjunction with one or more additional sensors to provide for situational awareness, steering, facial recognition, if-this-then-that style automatic control, and other system controls or operating protocols.

In accordance with certain exemplary use cases, a user may operably configure portable microphone array system 300 by disposing the interior surface of laptop computer case 302 around the exterior surface of laptop 308, such that laptop computer case 302 may open and close with the hinged display screen of laptop 308. Laptop computer case 302 may comprise retaining straps that may be removably coupled to upper corners of the laptop display screen and the laptop body. Microphone array 304 may be operably configured to deliver a first stage of beamformed audio to laptop computer 308 via a system bus or wireless communications interface.

Still referring to FIG. 3A and in accordance with various aspects of the present disclosure, portable microphone array system 300 may be operably configured to process an audio input received at microphone array 304 and render an audio output to a user 310. In accordance with certain exemplary use cases, a user 312 may position laptop computer case 302 to steer a directivity pattern of microphone array 304 to capture an audio input from a target audio source. Incoming acoustic signals may pass through an outer surface (or aperture(s)) of laptop computer case 302 to reach microphone array 304. Microphone array 304 may capture the incoming acoustic signals and deliver a first stage of beamformed audio to laptop computer 308. Laptop computer 308 may further process the beamformed audio to render a processed audio output. The processed audio output may be delivered to an audio output device (e.g. headphones) 314 to enable user 312 to better hear target audio signals emanating from a target audio source.

Figure 4:
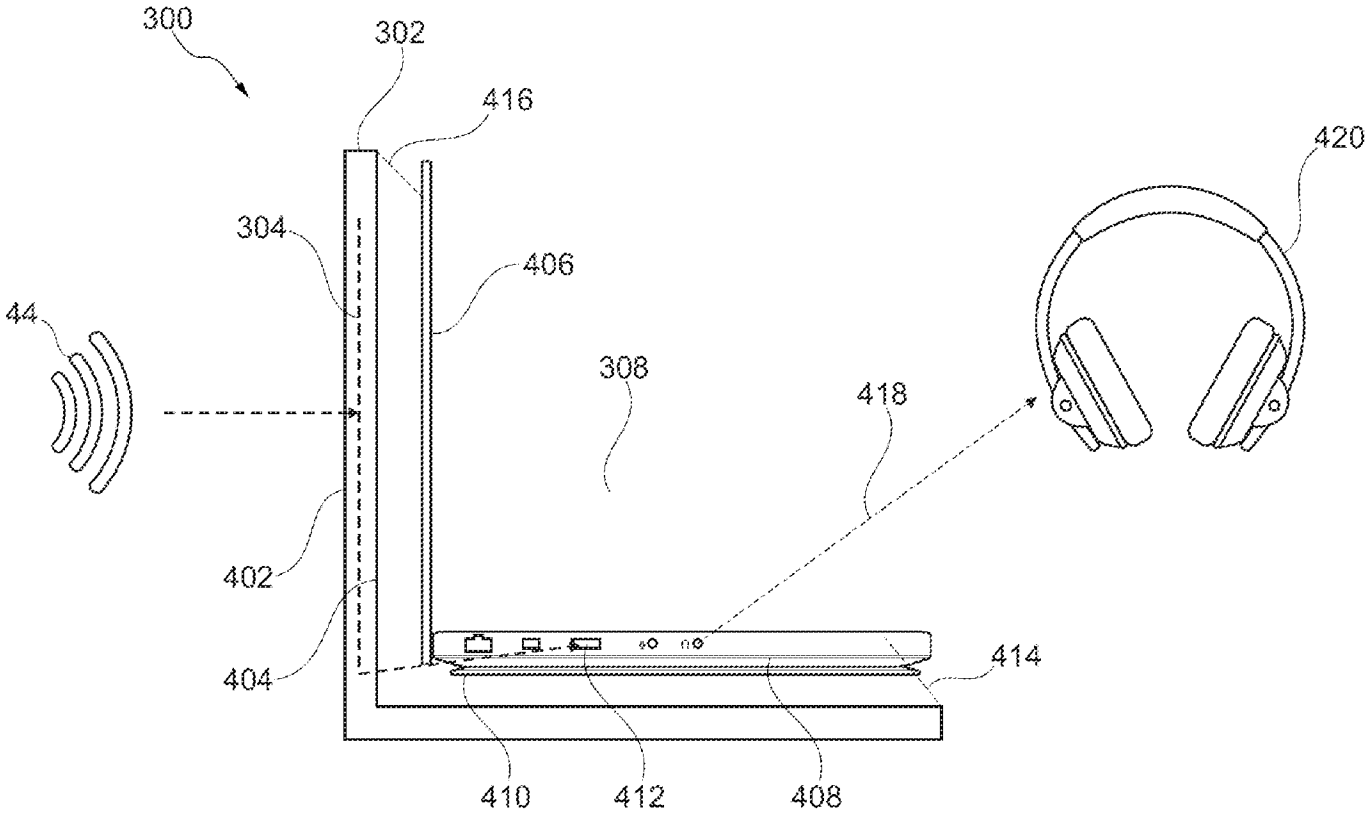
FIG. 4 is a functional diagram of a portable microphone array system, in accordance with an aspect of the present disclosure.

Referring now to FIG. 4, a functional diagram of portable microphone array system 300 is shown. In accordance with an aspect of the present disclosure, laptop computer 308 is selectively interfaced with laptop computer case 302. One or more retaining straps 416 may secure display screen 406 to an inner surface 404 of laptop computer case 302; and one or more retaining straps 414 may secure laptop computer body 408 to inner surface 404 of laptop computer case 302. Outer surface 402 and inner surface 404 may be primarily constructed of a fabric material. In accordance with certain embodiments, outer surface 402 comprises a fabric material of a type and construction being operable to enable acoustic signals 44 to pass therethrough. Microphone array 304 may comprise a plurality of transducers (e.g. microphones). The plurality of transducers may be individually wired or woven into outer surface 402 and/or inner surface 404. In certain embodiments, microphone array 304 may comprise an array surface, such as a flexible printed circuit board (PCB), wherein each transducer in the plurality of transducers may be surface mounted on the array surface. In such an embodiment, microphone array 304 may be housed between outer surface 402 and inner surface 404 and oriented such that the plurality of transducers is configured to receive target acoustic input 44 through outer surface 402.

In accordance with certain aspects of the present disclosure, microphone array 304 is operably configured to communicate an audio input 410 to laptop computer 308 via a wireless (e.g. Bluetooth) or wireline (e.g. bus) communications interface 412. Laptop computer 308 may comprise an audio processing module configured to perform one or more successive stages of audio processing to process audio input 410 and render/output a processed audio output to an output device 420 via an output connector or wireless communications interface 418.

Figure 5:
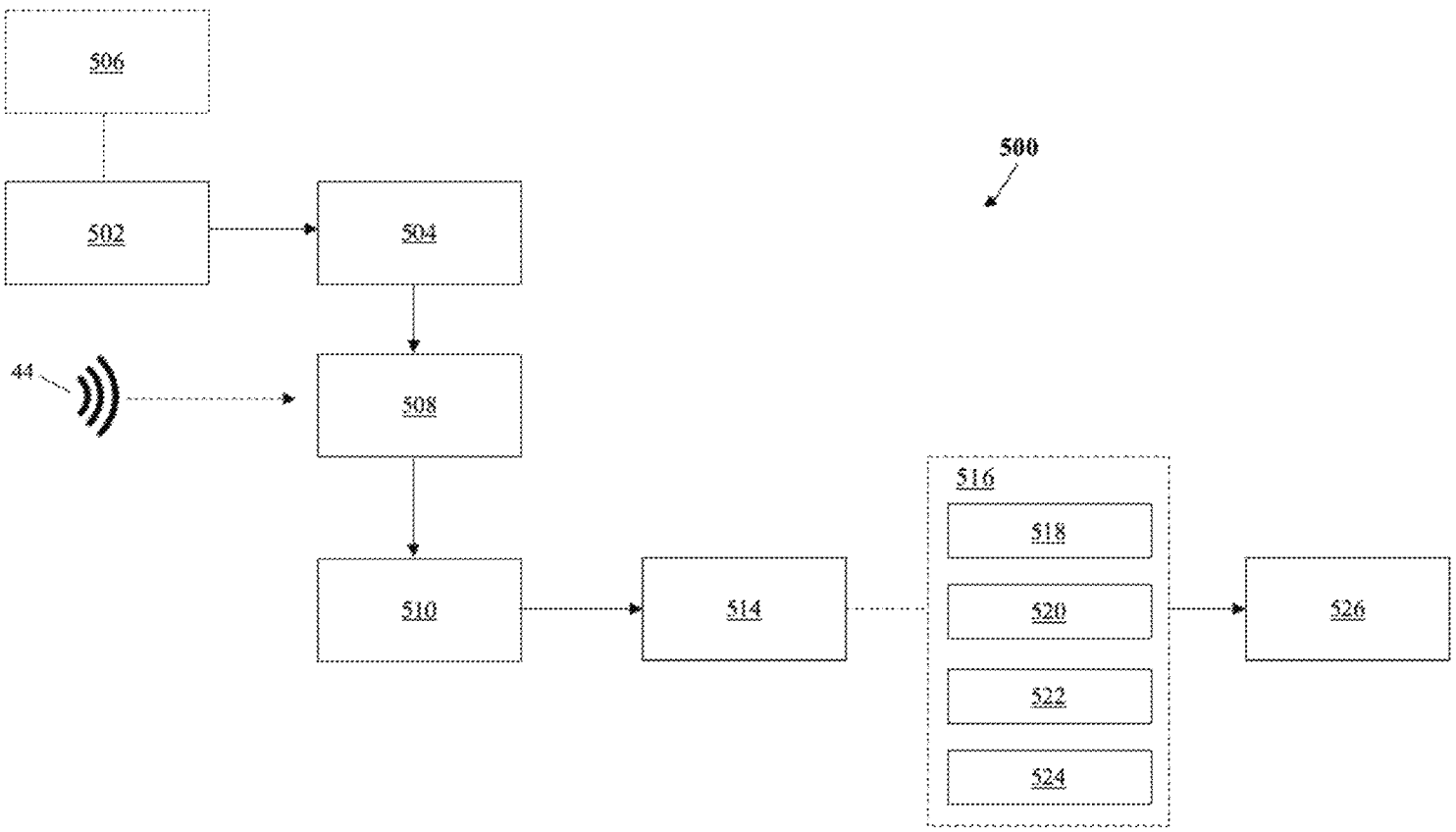
FIG. 5 is a functional block diagram of a portable microphone array system, in accordance with an aspect of the present disclosure.

Referring now to FIG. 5, a functional block diagram of a process flow 500 of a portable microphone array system is shown. In accordance with an aspect of the present disclosure, process flow 500 may be implemented within portable microphone array system 300 (as shown in FIGS. 3 and 4). In accordance with an embodiment, a user selectively interfaces a laptop computer case comprising an embedded or integrated microphone array with a laptop computer such that the laptop computer is removably housed within the laptop computer case (Block 502). A wireless or wired communications interface may be established between the laptop computer case and the laptop computer such that an audio input data may be communicated from the microphone array to the laptop computer (Block 506). In accordance with certain aspects of the present disclosure, the laptop computer and the laptop computer case are selectively configured by a user such that the microphone array is positioned in the direction of a target audio source (Block 504). The microphone array may be engaged in an operational mode by the user via one or more control settings executing on the laptop computer, and/or an electronics module operably engaged with the microphone array, to receive an audio input 44 (Block 508). Audio input 44 may comprise an acoustic audio input comprising one or more audio signals from an acoustic environment (e.g. a classroom or a lecture hall) and may further comprise one or more target audio signals and non-target audio signals. In certain embodiments, the one or more target audio signals may be associated with audio signals emanating from inside a three-dimensional point source within the acoustic environment, and the non-target audio signals may comprise audio signals emanating from outside the three-dimensional point source within the acoustic environment. In accordance with an embodiment, the target audio signal comprises a speaker's voice and the three-dimensional point source comprises a location of the speaker within the acoustic environment. In some embodiments, audio input 44 may comprise a live audio input and/or a recorded audio input. In embodiments where audio input 44 comprises a live audio input, a microphone array may be configured to beamform acoustic signals into single or multiple groups in a first stage of beamforming directly onto an electrical bus into single or multiple channels to produce a first stage of beamformed audio from the acoustic signals (Block 510). Audio input 44 may be communicated to an audio processing module executing, at least partially, on the laptop computer to perform one or more successive audio processing steps (Block 512). In certain embodiments, the one or more audio processing steps may comprise one or more spatially audio processing steps of routine 700 and/or routine 800 (as shown in FIGS. 7 and 8). In certain embodiments, the one or more audio processing steps may comprise one or more of a time delay step 518, a second (or successive) stage beamforming step 520, a gain or volume control step 522 and/or audio a filtering step 524. In certain embodiments, one or more of audio processing steps 518-524 may be implemented sequentially, successively and/or concomitantly with the one or more spatially audio processing steps of routine 700 and/or routine 800 (as shown in FIGS. 7 and 8). In accordance with certain embodiments, the audio processing module is configured to render and output a processed audio output to an audio output device (Block 526). A user may utilize the audio output device to improve his or her ability to hear the target audio source in noisy, reverberant, and/or other environments that might pose challenges to clear hearing of a target audio source.

Figure 6:
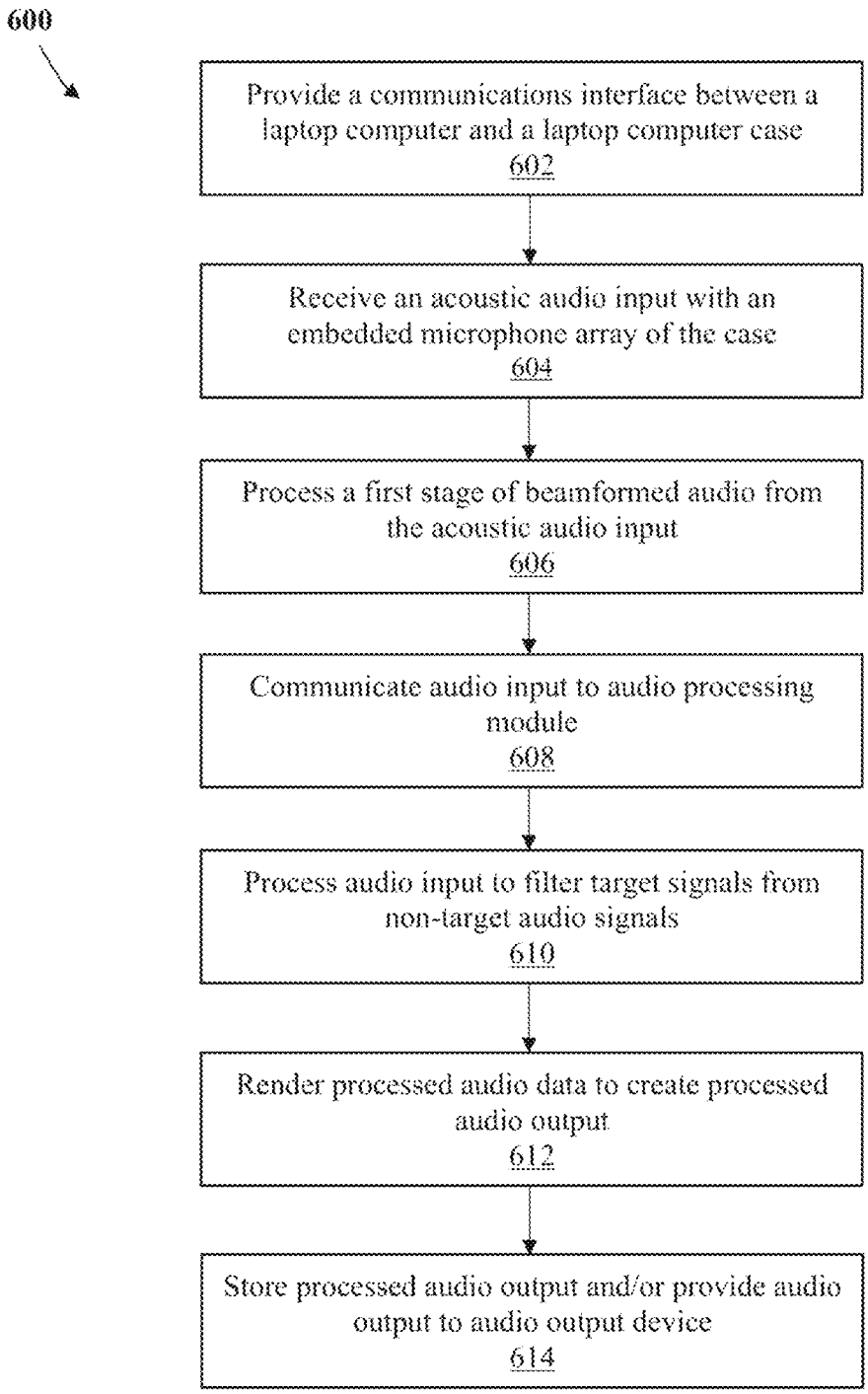
FIG. 6 is a process flow diagram of a portable microphone array system, in accordance with an aspect of the present disclosure.

Referring now to FIG. 6, array processing method 600 of a portable microphone array system is shown. In certain embodiments, audio processing method 600 may be implemented, in whole or in part, within portable microphone array system 300 (as shown in FIG. 4). In certain embodiments, array processing method 600 may comprise one or more audio processing steps of routine 700 and/or routine 800 (as shown in FIGS. 7 and 8). In accordance with an aspect of the present disclosure, array processing method 600 is initiated by providing a data transfer interface between a laptop computer case and a laptop computer (Step 602). In an exemplary embodiment, the laptop computer case comprises an integrated microphone array being configured to receive an acoustic audio input. In certain embodiments, the laptop computer is housed in an interior portion of the laptop computer case. Method 600 may continue by receiving incoming acoustic signals at the integrated microphone array (Step 604). In accordance with certain embodiments, acoustic signals may be beamformed in single or multiple groups in a first stage of beamforming directly onto an electrical bus into single or multiple channels to produce a first stage of beamformed audio from the acoustic signals (Step 606). Method 600 may continue by communicating, via the data transfer interface, the audio input from the microphone array to an audio processing module (Step 608). In certain embodiments, the audio processing module is located, at least in part, on the laptop computer. Method 600 may continue by processing the audio input according to one or more successive audio processing steps to filter one or more target audio signals from one or more non-target audio signals from within the audio input (Step 610). The one or more successive audio processing steps may comprise a single stage of beamforming; spatial audio processing without beamforming (e.g. Green's Function methods); and/or may apply beamforming of groups of microphones followed by Green's Function training on those groups and/or Green's Function processing of those groups. According to an embodiment, array processing method 600 may continue by rendering the processed audio data to create processed audio output comprising the one or more target audio signals (Step 612). Array processing method 600 may continue by storing the processed audio output in a memory device and/or providing the processed audio output to at least one audio output device (e.g. headphones or a hearing aid) (Step 614).

In accordance with certain aspects of the present disclosure, the one or more audio processing steps discussed in the detailed description to FIGS. 1-6, above, may comprise one or more spatial audio processing techniques/methodologies for spatially filtering one or more target audio signals from one or more non-target audio signals (i.e., "noise") from an acoustic audio input. In certain embodiments, the one or more spatial audio processing routines may comprise audio processing routine 700 and/or audio processing routine 800 (as shown in FIGS. 7-8). Referring now to FIG. 7, audio processing routine 700 for use with a portable microphone array apparatus and system is shown. In accordance with certain aspects of the present disclosure, audio processing routine 700 comprises one or more spatial audio processing routines executing, at least in part, on an audio processing module of a computing device. In certain embodiments, the computing device comprises a portable computing device associated with portable microphone array system 300 (as shown in FIGS. 3 and 4). In certain embodiments, audio processing routine 700 may be comprise one or more aspects of audio processing method 200 and/or array processing routine 600 (as shown in FIGS. 2 and 6). In certain embodiments, one or more steps of audio processing routine 700 may be implemented sequentially, successively and/or concomitantly to one or more steps of audio processing routine 800 (as shown in FIG. 8). In accordance with an aspect of the present disclosure, audio processing routine 700 may be initiated by receiving, at an audio processing module, an audio input comprising live and/or recorded audio signals associated with an acoustic location (Step 712). In an embodiment, the audio input is an acoustic audio input received by a microphone array communicably engaged with a computing device. In certain embodiments, the computing device is a laptop computer. Routine 700 may continue by processing the audio input to select an audio segment during which a target sound source is active to derive a target audio input or training audio input (Step 702). Audio processing routine 700 may proceed by converting the audio input from the time domain to the frequency domain via a transform function, such as the Fast Fourier transform (Step 704). Audio processing routine 700 may continue by selecting time-frequency bins containing sufficient source location for a target audio signal associated with a three-dimensional point source within an acoustic environment (Step 706). Audio processing routine 700 may continue by calculating an acoustic propagation model for three-dimensional point source using a normalized cross power spectral density to estimate a Green's Function for the target audio signal (Step 708). Audio processing routine 700 may continue by exporting the acoustic propagation model to be utilized in routine 800 (as shown in FIG. 8) (Step 710). In certain embodiments, the acoustic propagation model may be stored in a memory device being communicably engaged with audio processing module for future use by routine 800 (as shown in FIG. 8). In certain embodiments, steps 704, 706, and 708 may be executed on a per frame of data basis.

Referring now to FIG. 8, an audio processing routine 800 for use with a portable microphone array apparatus and system is shown. In accordance with certain aspects of the present disclosure, audio processing routine 800 comprises one or more spatial audio processing routines executing, at least in part, on an audio processing module of a computing device. In certain embodiments, the computing device comprises a portable computing device associated with portable microphone array system 300 (as shown in FIGS. 3 and 4). In certain embodiments, audio processing routine 800 may be comprise one or more aspects of audio processing method 200 and/or array processing routine 600 (as shown in FIGS. 2 and 6). In certain embodiments, one or more steps of audio processing routine 800 may be implemented sequentially, successively and/or concomitantly to one or more steps of audio processing routine 700 (as shown in FIG. 7). In accordance with an aspect of the present disclosure, audio processing routine 800 may be initiated by receiving, at an audio processing module, an audio input comprising live and/or recorded audio signals being associated with an acoustic environment (Step 816). In an embodiment, the audio input comprises an acoustic audio input received by a portable microphone array communicably engaged with a computing device. In certain embodiments, the computing device is a laptop computer. Audio processing routine 800 may continue by converting the audio input from the time domain to the frequency domain via a transform such as the Fast Fourier transform (Step 802). Audio processing routine 800 may continue by applying the stored or live Green's Function propagation model for acoustic location 810. Audio processing routine 800 may proceed by calculating a whitening filter using inverse noise spatial correlation matrix (Step 804). Audio processing routine 800 may proceed by applying the Green's Function estimate and the whitening filter to the audio input within the frequency domain to extract the target audio signal and suppress non-target signals (i.e., noise) from the audio input (Step 806). Audio processing routine 800 may proceed by converting the resulting processed audio data from Step 806 from the frequency domain to the time domain via an inverse transform function, such as an Inverse Fast Fourier transform (Step 808). In accordance with certain embodiments, steps 802, 804, 806, and 808 may be executed per frame of audio data. Audio processing routine 800 may conclude by storing, exporting, and/or rendering an audio output comprising the extracted and whitened target audio signal for acoustic location from the processed audio data (Step 812). Audio processing routine 800 may optionally comprise an audio equalization Step 814 configured to adjust the balance between frequency components comprising the audio output. Audio equalization may be a component of rendering in Step 812.

Figure 9:
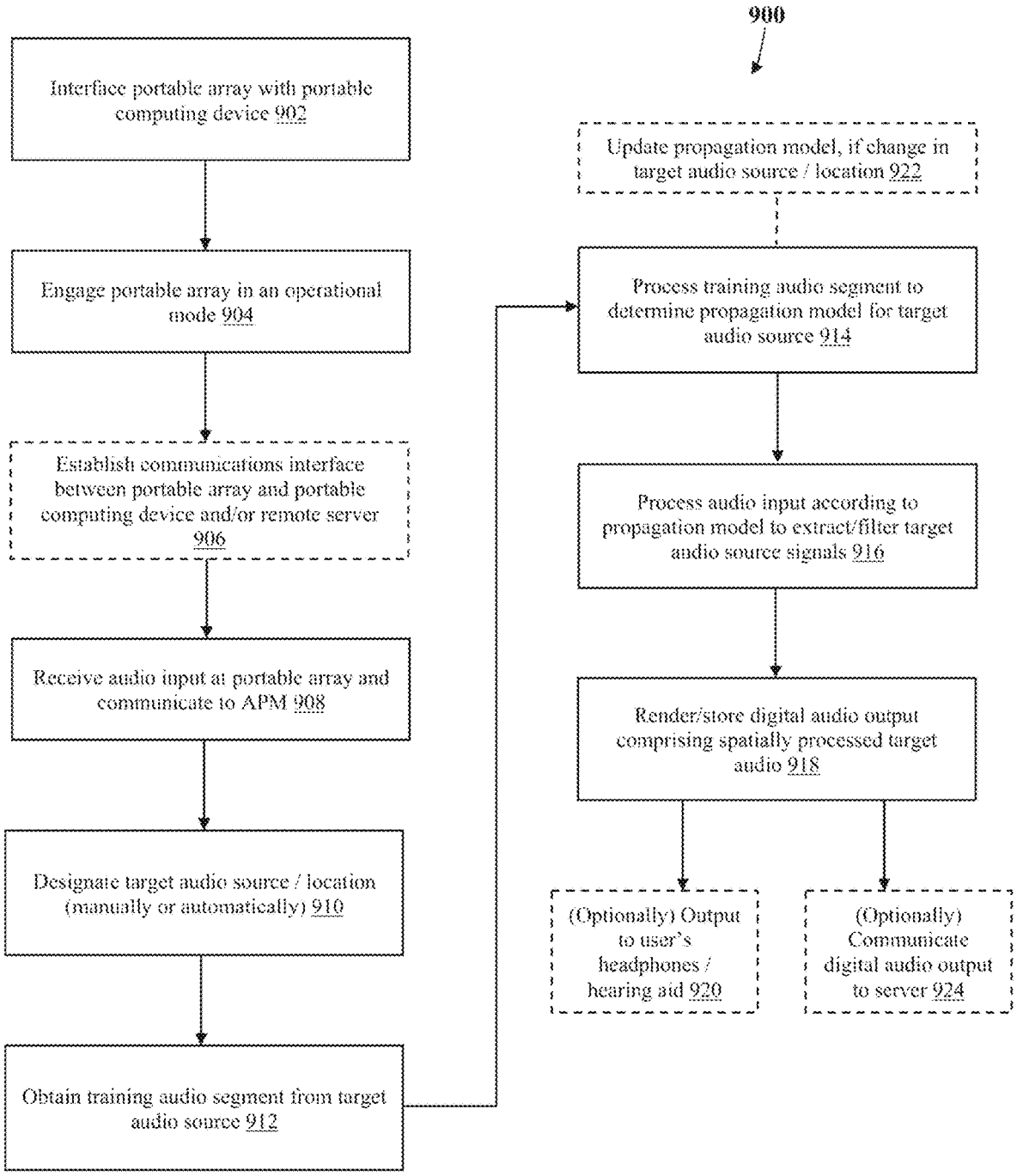
FIG. 9 is a process flow diagram of an audio processing method incorporated within a portable microphone array system, in accordance with various embodiments of the present disclosure.

Referring now to FIG. 9, a process flow diagram of a spatial audio processing method incorporated within a portable microphone array system is shown. In accordance with certain aspects of the present disclosure, method 900 may be comprised of method steps 902-922 and may be implemented or otherwise embodied within portable microphone array apparatus and system; for example, the portable microphone array apparatus and system as shown and described in FIGS. 1-5. In accordance with an embodiment, method 900 is initiated upon interfacing a portable microphone array with a portable computing device (Step 902). Method 900 may continue upon engaging the portable microphone array in an operational mode (Step 904) to provide power to the microphone array and enable the portable microphone array system to receive incoming acoustic audio signals. In certain embodiments, method 900 may continue by establishing a data transfer interface between the portable microphone array and the portable computing device and/or a remote server (Step 906). Upon engaging the wearable microphone array apparatus in an operational mode (Step 904), method 900 may continue by receiving acoustic signals at the microphone array and communicating an audio input to an audio processing module executing at least in part on the portable computing device (Step 908). In certain embodiments, the audio input may be derived from an environmental or physical location in which one or more human speakers are present; for example, a lecture hall or a classroom. Method 900 may continue by designating a target audio source and/or source location within the acoustic audio input (Step 910). A target audio source may include, for example, a specific human speaker within the environmental or physical location. A target audio location may include, for example, a specific location from which the speaker or other target audio source may be active, such as a podium in a classroom. In accordance with certain embodiments, Step 910 may be configured to designate the target audio source/location automatically by performing a first stage of processing to determine the loudest/strongest source signal present within the acoustic audio input and assign the signal as the target audio source/location. In other embodiments, Step 910 may be configured to designate the target audio source/location manually in response to an input from a user indicating when the target audio source is active in the acoustic audio input. Upon identifying the target audio source within the acoustic audio input (Step 910), method 900 may continue by obtaining a training audio segment comprising an audio input in which the target audio source is present (Step 912). The training audio segment may then be processed to determine an acoustic propagation model for the target audio source within the environmental or physical location (Step 914). In accordance with certain embodiments, Step 914 may comprise one or more audio processing steps of routine 700, as shown and described in FIG. 7. In certain embodiments, method 900 may be configured to obtain a new/different training audio segment and update the propagation model if there is a change in the target audio source and/or the location of the target audio source (Step 922); for example, if the user desires to select a new speaker as the target audio source and/or the target audio source moves to a different position within the environmental or physical location. Method 900 may execute Step 922 automatically by analyzing one or more spatial or spectral characteristics of the target audio source within the acoustic audio input to verify the accuracy of the propagation model. Alternatively, method 900 may execute step 922 manually in response to a user input being configured to select a new target audio source. Method 900 may continue by processing, on a per frame of audio basis, the acoustic audio input (when target audio source is active) according to the propagation model to spatially filter/extract target audio signals from the acoustic audio input (Step 916). Step 916 may further comprise applying a whitening filter to suppress non-target signals (i.e., noise) from the acoustic audio input. In accordance with certain embodiments, Step 916 may comprise one or more audio processing steps of routine 800, as shown and described in FIG. 8. Method 900 may continue by rendering and/or storing a digital audio output comprising the spatially processed target audio signals (Step 918). In certain embodiments, method 900 may be further configured to output the digital audio output of Step 918 to headphones or a hearing aid of the user of the portable microphone (Step 920). In certain embodiments, method 900 may be further configured to communicate the digital audio output of Step 918 to a remote server for storage, further processing, and/or output to one or more audio output devices (Step 924).

Figure 10:
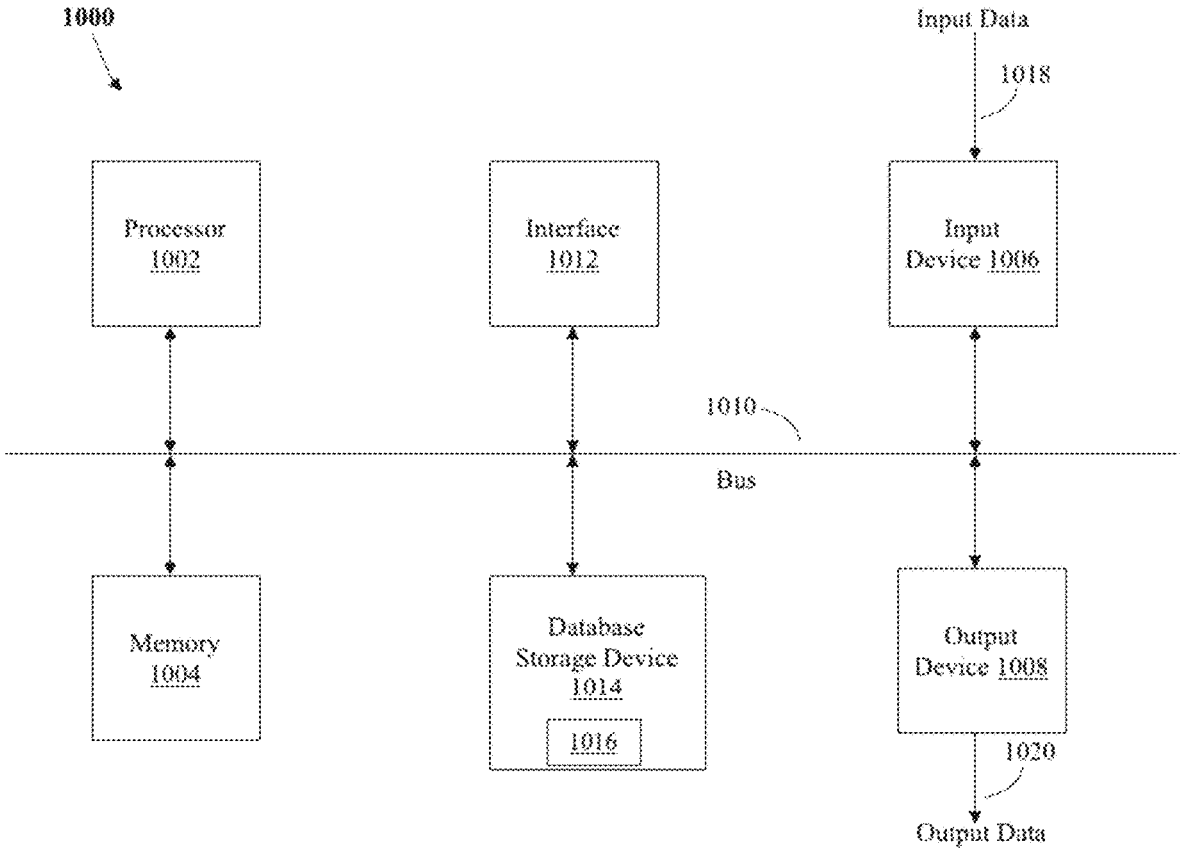
FIG. 10 is a functional block diagram of a processor-implemented computing device in which one or more aspects of the present disclosure may be implemented.

Referring now to FIG. 10, a functional block diagram of an exemplary computing system in which one or more aspects of the present disclosure may be implemented is shown. According to an embodiment, a computing system 1000 may generally comprise at least one processor 1002, or a processing unit or plurality of processors, memory 1004, at least one input device 1006 and at least one output device 1008, coupled together via a bus or a group of buses 1010. In certain embodiments, input device 1006 and output device 1008 could be the same device. An interface 1012 can also be provided for coupling the computing system 1000 to one or more peripheral devices, for example interface 1012 could be a PCI card or a PC card. At least one storage device 1014 which houses at least one database 1016 can also be provided. The memory 1004 can be any form of memory device, for example, volatile or non-volatile memory, solid state storage devices, magnetic devices, etc. The processor 1002 can comprise more than one distinct processing device, for example to handle different functions within computing system 1000. Input device 1006 receives input data 1018 and can comprise, for example, a keyboard, a pointer device such as a pen-like device or a mouse, audio signal receiving device for voice-controlled activation such as a microphone, data receiver or antenna such as a modem or a wireless data adaptor, a data acquisition card, etc. Input data 1018 can come from different sources, for example keyboard instructions in conjunction with data received via a network. Output device 1008 produces or generates output data 1020 and can comprise, for example, a display device or monitor in which case output data 1020 is visual, a printer in which case output data 1020 is printed, a port, such as for example a USB port, a peripheral component adaptor, a data transmitter or antenna such as a modem or wireless network adaptor, etc. Output data 1020 can be distinct and/or derived from different output devices, for example a visual display on a monitor in conjunction with data transmitted to a network. A user could view data output, or an interpretation of the data output, on, for example, a monitor or using a printer. The storage device 1014 can be any form of data or information storage means, for example, volatile or non-volatile memory, solid state storage devices, magnetic devices, etc.

In use, the computing system 1000 is adapted to allow data or information to be stored in and/or retrieved from, via wired or wireless communication means, at least one data storage structure 1016. The interface 1012 may allow wired and/or wireless communication between the processing unit 1002 and peripheral components that may serve a specialized purpose. In general, the processor 1002 can receive instructions as input data 1018 via input device 1006 and can display processed results or other output to a user by utilizing output device 1008. More than one input device 1006 and/or output device 1008 can be provided. It should be appreciated that the processing system 1000 may be any form of terminal, server, specialized hardware, or the like.

It is to be appreciated that the computing system 1000 may be a part of a networked communications system. Computing system 1000 could connect to a network, for example the Internet or a WAN. Input data 1018 and output data 1020 can be communicated to other devices via the network. The transfer of information and/or data over the network can be achieved using wired communications means or wireless communications means. The transfer of information and/or data over the network may be synchronized according to one or more data transfer protocols between central and peripheral device(s). In certain embodiments, one or more central/master device may serve as a broker between one or more peripheral/slave device(s) for communication between one or more networked devices and a server. A server can facilitate the transfer of data between the network and one or more databases. A server and one or more database(s) provide an example of a suitable information source.

Computing system 1000 illustrated in FIG. 10 may operate in a networked environment using logical connections to one or more remote computers. In embodiments, the remote computer may be a personal computer, a server, a router, a network PC, a peer device, or other common network node, and typically includes many or all of the elements described above.

It is to be further appreciated that the logical connections depicted in FIG. 10 include a local area network (LAN) and a wide area network (WAN) but may also include other networks such as a personal area network (PAN). Such networking environments are commonplace in offices, enterprise-wide computer networks, intranets, and the Internet. For instance, when used in a LAN networking environment, computing system 1000 is connected to the LAN through a network interface or adapter. When used in a WAN networking environment, the computing system environment typically includes a modem or other means for establishing communications over the WAN, such as the Internet. The modem, which may be internal or external, may be connected to a system bus via a user input interface, or via another appropriate mechanism. In a networked environment, program modules depicted relative to computing system 1000, or portions thereof, may be stored in a remote memory storage device. It is to be appreciated that the illustrated network connections of FIG. 10 are exemplary and other means of establishing a communications link between multiple computers may be used.

FIG. 10 is intended to provide a brief, general description of an illustrative and/or suitable exemplary environment in which embodiments of the invention may be implemented. That is, FIG. 10 is but an example of a suitable computing apparatus, system and architecture and is not intended to suggest any limitations as to the structure, scope of use, or functionality of embodiments of the present invention exemplified therein. A particular environment should not be interpreted as having any dependency or requirement relating to any one or a specific combination of components illustrated in an exemplified operating environment. For example, in certain instances, one or more elements of an environment may be deemed not necessary and omitted. In other instances, one or more other elements may be deemed necessary and added.

As provided in the detailed description above, certain embodiments may be described with reference to acts and symbolic representations of operations that are performed by one or more computing devices, such as computing system 1000 of FIG. 10. As such, it will be understood that such acts and operations, which are at times referred to as being computer-executed, include the manipulation by the processor of the computer of electrical signals representing data in a structured form. This manipulation transforms data or maintains it at locations in the memory system of the computer, which reconfigures or otherwise alters the operation of the computer in a manner that is conventionally understood by those skilled in the art. The data structures in which data is maintained are physical locations of the memory that have particular properties defined by the format of the data. However, while certain embodiments may be described in the foregoing context, the scope of the disclosure is not meant to be limiting thereto, as those of skill in the art will appreciate that the acts and operations described hereinafter may also be implemented in hardware.

Certain aspects of the present disclosure may be implemented with numerous general-purpose and/or special-purpose computing devices and computing system environments or configurations. Examples of well-known computing systems, environments, and configurations that may be suitable for use with embodiments of the invention include, but are not limited to, personal computers, handheld or laptop devices, personal digital assistants, multiprocessor systems, microprocessor-based systems, set top boxes, programmable consumer electronics, networks, minicomputers, server computers, game server computers, web server computers, mainframe computers, and distributed computing environments that include any of the above systems or devices.

Embodiments may be described in a general context of computer-executable instructions, such as program modules, being executed by a computer. Generally, program modules include routines, programs, objects, components, data structures, etc., that perform particular tasks or implement particular abstract data types. An embodiment may also be practiced in a distributed computing environment where tasks are performed by remote processing devices that are linked through a communications network. In a distributed computing environment, program modules may be located in both local and remote computer storage media including memory storage devices.

As will be appreciated by one of skill in the art, the present invention may be embodied as a method (including, for example, a computer-implemented process, a business process, and/or any other process), apparatus (including, for example, a system, machine, device, computer program product, and/or the like), or a combination of the foregoing. Accordingly, embodiments of the present invention may take the form of an entirely hardware embodiment, an entirely software embodiment (including firmware, resident software, micro-code, etc.), or an embodiment combining software and hardware aspects that may generally be referred to herein as a "system." Furthermore, embodiments of the present invention may take the form of a computer program product on a computer-readable medium having computer-executable program code embodied in the medium.

Any suitable transitory or non-transitory computer readable medium may be utilized. The computer readable medium may be, for example but not limited to, an electronic, magnetic, optical, electromagnetic, infrared, or semiconductor system, apparatus, or device. More specific examples of the computer readable medium include, but are not limited to, the following: an electrical connection having one or more wires; a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device.

In the context of this document, a computer readable medium may be any medium that can contain, store, communicate, or transport the program for use by or in connection with the instruction execution system, apparatus, or device. The computer usable program code may be transmitted using any appropriate medium, including but not limited to the Internet, wireline, optical fiber cable, radio frequency (RF) signals, or other mediums.

Computer-executable program code for carrying out operations of embodiments of the present invention may be written and executed in a programming language, whether using a functional, imperative, logical, or object-oriented paradigm, and may be scripted, unscripted, or compiled. Examples of such programming languages include as Java, C, C++, Octave, Python, Swift, Assembly, and the like.

Embodiments of the present invention are described above with reference to flowchart illustrations and/or block diagrams of methods, apparatus (systems), and computer program products. It will be understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks.

These computer-executable program code portions may also be stored in a computer-readable memory that can direct a computer or other programmable data processing apparatus to function in a particular manner, such that the code portions stored in the computer readable memory produce an article of manufacture including instruction mechanisms which implement the function/act specified in the flowchart and/or block diagram block(s).

The computer-executable program code may also be loaded onto a computer or other programmable data processing apparatus to cause a series of operational phases to be performed on the computer or other programmable apparatus to produce a computer-implemented process such that the code portions which execute on the computer or other programmable apparatus provide phases for implementing the functions/acts specified in the flowchart and/or block diagram block(s). Alternatively, computer program implemented phases or acts may be combined with operator or human implemented phases or acts in order to carry out an embodiment of the invention.

As the phrase is used herein, a processor may be "configured to" perform a certain function in a variety of ways, including, for example, by having one or more general-purpose circuits perform the function by executing particular computer-executable program code embodied in computer-readable medium, and/or by having one or more application-specific circuits perform the function.

Embodiments of the present invention are described above with reference to flowcharts and/or block diagrams. It will be understood that phases of the processes described herein may be performed in orders different than those illustrated in the flowcharts. In other words, the processes represented by the blocks of a flowchart may, in some embodiments, be in performed in an order other that the order illustrated, may be combined or divided, or may be performed simultaneously. It will also be understood that the blocks of the block diagrams illustrated, in some embodiments, merely conceptual delineations between systems and one or more of the systems illustrated by a block in the block diagrams may be combined or share hardware and/or software with another one or more of the systems illustrated by a block in the block diagrams. Likewise, a device, system, apparatus, and/or the like may be made up of one or more devices, systems, apparatuses, and/or the like. For example, where a processor is illustrated or described herein, the processor may be made up of a plurality of microprocessors or other processing devices which may or may not be coupled to one another. Likewise, where a memory is illustrated or described herein, the memory may be made up of a plurality of memory devices which may or may not be coupled to one another.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The present disclosure includes that contained in the appended claims as well as that of the foregoing description. Although the invention has been described in various exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A portable microphone array system comprising:

a portable housing configured to be selectively coupled to a surface of a mobile electronic device;

a plurality of microphones disposed on a surface of the portable housing, the plurality of microphones comprising a microphone array configured to receive an arriving audio signal, wherein the microphone array is configured such that the plurality of microphones are oriented adjacent to the surface of the mobile electronic device when the mobile electronic device is selectively coupled to the portable housing; and output circuitry operably engaged with the plurality of microphones and configured to deliver a first stage audio input from the microphone array to the mobile electronic device, wherein the mobile electronic device comprises an audio processing module wherein the audio processing module is configured to process the arriving audio signal according to one or more audio processing steps to spatially filter at least one target audio signal from one or more non-target audio signals present within the arriving audio signal to generate a processed audio output, wherein the one or more audio processing steps comprise determining at least one acoustic propagation model for the at least one target audio signal, wherein the one or more audio processing steps comprise applying a whitening filter to the arriving audio signal, wherein the whitening filter is configured to suppress the one or more non-target audio signals from the processed audio output, wherein the whitening filter is calculated using an inverse noise spatial correlation matrix.

2. The portable microphone array system of claim 1 wherein the mobile electronic device is selected from the group consisting of: laptop computers, smartphones, tablet computers, digital display devices, and personal computers.

3. The portable microphone array system of claim 1 wherein the output circuitry further comprises at least one data transfer interface configured to deliver the first stage audio input from the microphone array to the mobile electronic device.

4. The portable microphone array system of claim 1 wherein the microphone array comprises one or more input channels.

5. The portable microphone array system of claim 4 wherein the output circuitry is configured to beamform audio signals from the one or more input channels to comprise the first stage audio input.

6. The portable microphone array system of claim 3 wherein the at least one data transfer interface comprises a wireless communications interface.

7. A portable microphone array system comprising:

a portable housing comprising a plurality of microphones coupled to a surface of the portable housing, the plurality of microphones comprising a microphone array configured to receive an arriving audio signal; and a computing device selectively coupled to a surface of the portable housing, the computing device comprising an audio processing module communicably engaged with the microphone array via at least one data transfer interface to receive the arriving audio signal, wherein the audio processing module is configured to process the arriving audio signal according to one or more audio processing steps to spatially filter at least one target audio signal from one or more non-target audio signals present within the arriving audio signal to generate a processed audio output, wherein the one or more audio processing steps comprise applying a whitening filter to the arriving audio signal, wherein the whitening filter is configured to suppress the one or more non-target audio signals from the processed audio output, wherein the whitening filter is calculated using an inverse noise spatial correlation matrix.

8. The portable microphone array system of claim 7 further comprising an audio output device operably engaged with the computing device to receive the processed audio output.

9. The portable microphone array system of claim 8 wherein the audio output device is selected from the group consisting of: headphones, hearing aids, loudspeakers, and audio cables.

10. The portable microphone array system of claim 7 wherein the plurality of microphones are oriented adjacent to a surface of the computing device when the computing device is selectively coupled to the portable housing.

11. The portable microphone array system of claim 7 wherein the audio processing module is configured to render the processed audio output comprising the at least one target audio signal.

12. The portable microphone array system of claim 7 wherein the one or more audio processing steps comprise calculating a normalized cross power spectral density for the arriving audio signal.

13. A portable microphone array system comprising:

a portable housing comprising a plurality of microphones comprising a microphone array configured to receive an audio input; and a computing device selectively coupled to at least one surface of the portable housing, the computing device comprising an audio processing module communicably engaged with the microphone array via at least one data transfer interface to receive the audio input, the audio processing module comprising at least one processor and a non-transitory computer readable medium having instructions stored thereon that, when executed, cause the processor to perform one or more audio processing operations, comprising:

processing the audio input to determine at least one acoustic propagation model for at least one source location within an acoustic environment;

processing the audio input according to the at least one acoustic propagation model to spatially filter at least one target audio signal from one or more non-target audio signals within the audio input to derive a processed audio output, wherein the at least one target audio signal corresponds to the at least one source location;

applying a whitening filter to the audio input, wherein the whitening filter is configured to suppress one or more non-target audio signals from the processed audio output, wherein the whitening filter is calculated using an inverse noise spatial correlation matrix; and rendering the processed audio output comprising the at least one target audio signal.

14. The portable microphone array system of claim 13 wherein the at least one acoustic propagation model comprises at least one Green's Function estimation.

15. The portable microphone array system of claim 13 further comprising an audio output device operably engaged with the computing device to receive the processed audio output.

16. The portable microphone array system of claim 15 wherein the audio output device is selected from the group consisting of: headphones, hearing aids, loudspeakers, and audio cables.

17. The portable microphone array system of claim 13 wherein the one or more audio processing operations further comprise calculating a normalized cross power spectral density for the audio input.

* * * * *